United States Patent [19]

Takagi et al.

[11] 4,024,302

[45] May 17, 1977

[54] METHOD FOR COATING RUNNING WEBS HAVING PROJECTING SPLICES

[75] Inventors: Akira Takagi; Sei Kawahara, both of Fujimiya; Hideo Takeda, Minami-ashigara, all of Japan

[73] Assignee: Fuji Photo Film Co., Ltd., Minami-ashigara, Japan

[22] Filed: Aug. 22, 1974

[21] Appl. No.: 499,678

[30] Foreign Application Priority Data

Aug. 22, 1973 Japan ..... 48-94194

[52] U.S. Cl. ..... 427/290; 427/292; 428/61; 156/154; 156/157; 156/280; 156/304; 51/323; 51/399

[51] Int. Cl.[2] ..... B05D 3/12

[58] Field of Search ..... 117/11, 2 R, 8, 8.5, 117/48, 34; 427/140, 142, 275, 290, 292, 261, 272, 276, 278, 300; 156/153, 304, 278, 280, 154, 157; 161/36, 161, 164, 116; 428/61, 167, 189, 192; 51/323, 399

[56] References Cited

UNITED STATES PATENTS

| | | | |
|---|---|---|---|
| 1,947,493 | 2/1934 | Rose et al. | 117/8 |
| 3,010,843 | 11/1961 | Eder | 117/8 X |
| 3,531,362 | 9/1970 | Bourns et al. | 156/304 X |
| 3,575,759 | 4/1971 | Pasquinelli | 156/153 X |
| 3,746,607 | 7/1973 | Harmon et al. | 161/116 X |
| 3,837,881 | 9/1974 | Hix | 51/311 |
| 3,850,669 | 11/1974 | Mino et al. | 117/48 |

*Primary Examiner*—Ronald H. Smith
*Assistant Examiner*—Evan K. Lawrence
*Attorney, Agent, or Firm*—Sughrue, Rothwell, Mion, Zinn & Macpeak

[57] ABSTRACT

In a method for continuously coating with a coating solution a plurality of running webs having discontinuous areas in the surface thereof, the improvement which comprises coarsening at least the surface of the web coated in the area of the web immediately following the discontinuous area of the web prior to the coating. The discontinuous areas in the surface can arise from the tape used to connect one web to another web or from projection in the surface of the web.

7 Claims, 5 Drawing Figures

METHOD FOR COATING RUNNING WEBS HAVING PROJECTING SPLICES

BACKGROUND OF THE INVENTION

1. Field of the Invention

This invention relates to a method for coating a plurality of webs having discontinuous areas in the surface, e.g., arising from lengthwise connections of the webs in series with adhesive tapes or the like and which are continuously conveyed during the coating, using various kinds of coating solutions. More precisely, this invention relates to a method for applying coating solutions onto webs having discontinuities, preventing coating defects which tend to be caused downstream of the discontinuities.

2. Description of the Prior Art

Manufacture of films, papers, tapes and the like products by coating various kinds of coating solutions on webs of plastic film, paper, metal plate or the like and drying the coated layer is extensively carried out in various fields of the manufacture of photographic films, photographic papers, magnetic recording tapes, adhesive tapes, no-carbon papers and PS plates.

In the manufacture of these products, it is advantageous to substantially continuously carry out the coating operation, and therefore, the coating operation is actually successively carried out without a pause, generally, by continuously conveying webs of limited lengths which are connected lengthwise in series to a coating zone where the connected webs are coated with a coating solution. In connecting the webs, it is known that the so-called butt joint where webs are connected end to end with a splicing adhesive tape is preferred, that the splicing tape is applied more preferably on the surface of the web to be coated than on the opposite surface thereof, and that the surface of the splicing tape is preferably previously treated thereby to render the surface character of the splicing tape very similar to that of the surface of the web to be coated.

However, when a fluid coating solution is coated on the connected portion of the webs in a continuous coating operation, some seriously defective phenomena are known to often occur mainly in the area following the connected portion of the webs.

More precisely, one defect in the continuous coating of connected webs is that air is trapped between the surface of web and the coated layer in the area just following the connected portion, forming bubbles therein, and the formed bubbles adhere to coating nozzles, afterwards causing formation of streaks or the like on the surface of the coated layer extending over a fairly long distance in the surface of web. Another defect is the occurrence of uncoated or extremely thinly coated areas and a subsequent localized too thickly coated area on the surface of web in the area just following the connected portion, due to a step-like discontinuity in the surface evenness between the trailing edge of the splicing tape and the adjacent web surface and to the above-described air bubbles formed in the coated layer. The too thickly coated area requires a longer time for drying in the subsequent drying step, as compared with other areas which are coated normally. When the drying step is insufficient for drying the too thickly coated area, the thickly coated area remains undried and the undried coating solution thereon is transferred to rollers and other parts of the equipment used, thus contamination of the equipment in the subsequent steps, and ultimately other normally coated areas of the webs are stained. Thus, the too thickly coated area containing undried coating solution consequently causes a fatal defect in the quality of the product as mentioned above. Therefore, when the apparatus is stained, it is necessary to stop the manufacture procedure to clean the apparatus, which results in extreme reduction of manufacturing efficiency. On the other hand, if the occurrence of the undried area is to be prevented, the drying step must have an unneeded capacity for sufficiently drying the localized too thickly coated area. However, the thickly coated area cannot be used for manufacture of commercial products and must be discarded. Therefore, it is extremely uneconomical to spend money for drying capacity for this portion which is to be discarded.

In the above explanation, one embodiment is given where a plurality of webs is butt spliced. In addition, when the surface of web to be coated has projections or step-like discontinuities in surface level or other discontinuities, analogous coating difficulties such as coating specks, e.g., very small uncoated or too-thickly coated areas, or the like occur.

Some devices have heretofore been proposed for preventing the above described coating difficulties resulting from discontinuities in the splicing tape or the like.

One is suggested in U.S. Pat. No. 3,531,362. The outline of the method is as follows: prior to coating a solution on a web containing discontinuities (1) an oily-hydrophobic substance is applied on the discontinuous area and the adjacent web surface and the area following the discontinuous area, or (2) the splicing tape is inclined from the leading edge to the following edge to eliminate the level difference formed between the end portion of the discontinuous area and the substrate film.

In the above method (1), however, the oily-hydrophobic substance is, in general, incompatible with an aqueous coating solution, often causing adhesion difficulties of the coated layer. Also, there is the danger that the coated layer will peel off after drying due to a slight external shock in the steps following the drying step. In addition, this method requires the additional treatment of the surface of the discontinuous area with the oily-hydrophobic solution and this operation includes a danger of contamination of apparatus and other areas of the webs due to the use of the treating solution. Furthermore, a drying device having a larger capacity than necessary, as the case may be, is required for fully drying the coated pre-treating solution.

On the other hand, method (2) is not practical, in view of the shape and thickness of the splicing adhesive tape. More particularly, the splicing tape used for connecting webs generally comprises a substrate having a thickness of 10 to 50 $\mu$ or so coated with an adhesive. The total thickness of the tape comprising the substrate and adhesive is at most 30 to 100 $\mu$ or so. For attaining a sufficient effect in this method, it is necessary to incline even the adhesive portion, but it is extremely difficult to incline the trailing edge of such a thin tape even though the inclination is effected before or after the tape is adhered to the webs.

In addition, a method for varying the thickness by packing the space between the trailing edge of the tape and the surface of web with a rubber-cement material after the tape has been adhered to the web is complicated, and moreover, this method has the additional disadvantage that other areas of the webs as well as the equipment are contaminated, which is similar to the above described method where treatment with an oily-hydrophobic substance is carried out.

Another method is disclosed in British Pat. No. 1,243,663. In this method, water is applied to at least the trailing edge of a splicing tape in a previous spraying or coating, and a coating solution is coated before the water is completely dried.

However, this method has defects in that (*a*) a complicated apparatus is required to detect the splicing tape just before the area to be coated and to apply water just to the trailing edge of the splicing tape, (*b*) the layout of the passage of the web in the vicinity of the area to be coated is limited, since the surface of the web cannot be supported with a roller or the like in contact therewith after water has been applied thereto, and (*c*) when the web does not absorb water well, water drops on the web are transferred to the coating device such as coating nozzles, adversely affecting the subsequent coating operation.

SUMMARY OF THE INVENTION

One object of this invention is to overcome coating difficulties in coating of webs with discontinuous areas such as areas connected with tapes, and more precisely to prevent occurrence of coating specks in the portion following the discontinuous area.

Another object of the invention is to completely avoid contamination of the apparatus and other areas of the webs to be coated overcoming the above-described coating difficulties.

Still another object of the invention is to provide a simplified and effective method which does not require a complicated apparatus to conduct and which is free from the above-described coating difficulties.

A further object of this invention is to reduce unneeded expenses in drying and to provide an economical drying step by avoiding these prior art coating difficulties including localized thick coatings.

Accordingly, this invention provides a method for coating webs having discontinuous areas, e.g., webs which are connected lengthwise in series, for example with splicing tapes, thus having discontinuous areas, on the surface of the webs, and which are conveyed during the coating, with various kinds of coating solutions, comprising coarsening the surface of the webs to be coated prior to the coating in at least the area of the web immediately following the discontinuity.

The description "coarsening of the surface" includes roughening the surface of the web or imparting the characteristics of the so-called "silk-mesh" to the surface of the web, imparting a relatively large-sized roughness to the surface of the web with a knurling tool and imparting a relatively fine roughness thereto with an abrasive such as sandpaper so that the surface is no longer smooth. The description "discontinuous area" or "discontinuity" is used herein to designate relatively abrupt changes in the surface levels of adjacent surface areas, e.g., drops or step-like changes in the surface level. In addition the terms "leading" "preceding", "succeeding", and "trailing" have been used to designate physical position or location and are used in reference to the direction of travel of the web.

BRIEF DESCRIPTION OF THE ACCOMPANYING DRAWINGS

The present invention will be explained in greater detail with reference to the accompanying drawings.

DESCRIPTION OF PREFERRED EMBODIMENTS

Figure 1:
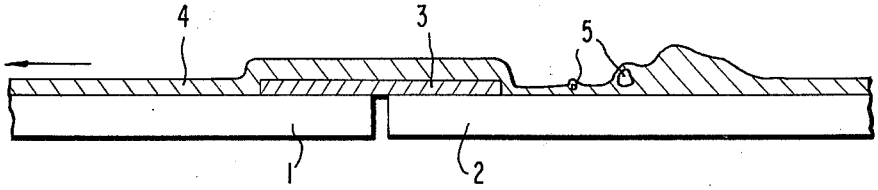
FIG. 1 is a sectional view of butt spliced web on which a coating solution has been applied without any specific treatment.

With reference to FIG. 1, one end of a preceding web 1 is connected lengthwise with another end of a succeeding web 2 using a splicing tape 3. (This connection is the so-called butt joint.) The connected web is conveyed in the direction of the arrow, passing through a coating device. A coating solution layer 4 a substantially liquid material, and the coating solution is uniformly applied to the surface of the web in the coating device and then solidified and dried thereon. However, in the vicinity of the connected area, uniform coating cannot be achieved due to the discontinuity on the surface of the connected web resulting from the splicing tape. More precisely, as shown in FIG. 1, an extremely thin coating or non-coating and the following locally too thick coating occur in the area immediately after the splicing tape. The thus unevenly coated part often contains air bubbles 5.

This phenomenon is presumed to result from the following. When the trailing edge of the connecting tape is passing through a coating device, air is trapped in a triangular space formed by the trailing edge of tape, the surface of the web and the layer of coating solution, and the coating solution layer hangs over a thin air layer in the area just after the trailing edge of the tape. The thus trapped air and the coating solution layer hanging thereover are moved backward in the direction of web travel, slipping over the surface of the web, as the coating progresses further. When moved backward, the air is incorporated into the coating solution layer and ultimately entrained therein to form air bubbles 5. It is presumed that the coating solution layer, after moving backward, would form a too thickly coated area.

Uneven coating is more marked when the conveying speed of the web is higher. Air bubbles 5 adhere to the coating device such as coating nozzles, often causing defective streaks on the following surface of the coated layer. The locally too thickly coated area remains undried in the subsequent drying step even after other normally coated areas have been already completely dried. Therefore, additional unnecessary drying capacity is required for drying the undried thick area. However, the thickly coated area cannot be used for the manufacture of products and is discarded, and so the provision of unnecessary drying capacity is extremely disadvantageous.

Figure 2:
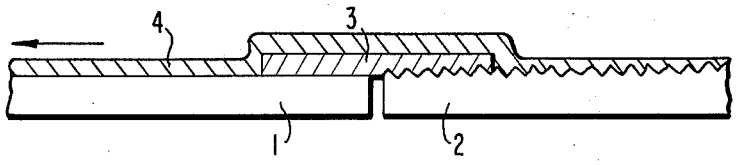
FIG. 2, FIG. 3 and FIG. 5 are sectional view of butt spliced webs, showing embodiments of this invention.

FIG. 2 shows one embodiment of this invention.

A preceding web 1 and a succeeding web 2 are butt spliced using a tape 3, in the same manner as described in FIG. 1, and the surface to be coated of the succeeding web 2 is coarsened by means of a so-called "silk-mesh knurling." It has been experimentally clarified that when a web having such coarsened surface in the connected area is coated with a coating solution, the above-described coating difficulty in the area just after the splicing tape can be completely avoided or markedly reduced. This is presumed to be because a slipping of the air layer trapped in the triangular space formed in the area of the web just after the trailing edge of the tape and of the coating solution layer hanging over the air layer can effectively be avoided due to the coarse surface of the web 2. The resulting coating is shown as layer 4.

Figure 3:
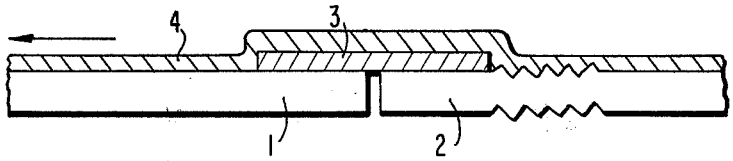
Figure 4:
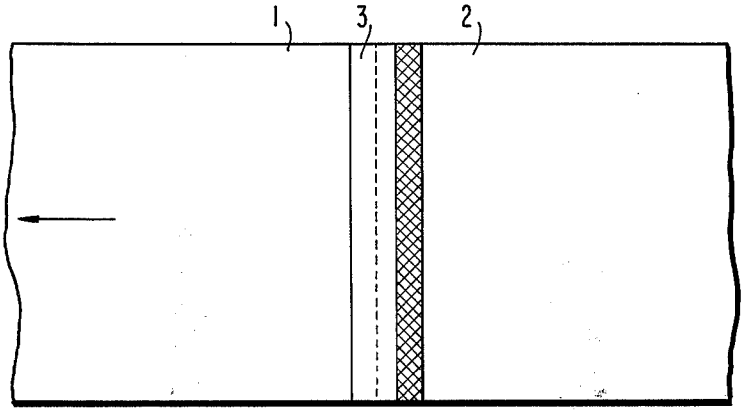
FIG. 4 is a plane view corresponding to FIG. 5.

FIG. 3 and FIG. 4 show another embodiment of this invention. With reference to FIG. 3 showing a sectional view, a preceding web 1 and a succeeding web 2 are butt spliced with a splicing tape 3, and the surface of the succeeding web 2 is coarsened by knurling in the area of the web just after the splicing tape. The resulting coating is shown as layer 4. FIG. 4 is a plane view corresponding to FIG. 3 but without coating 4. The surface treatment for coarsening the surface of the web can be carried out in the actual step using a simple knurling tool or a press-roller having a roughened surface, before the area to be coarsened is coated. For example, one method is to carry out the coarsening together with the connecting operation. When the web 1 having the connected area as shown in FIG. 3 is conveyed in the direction of the arrow to pass through a coating device, coating difficulty in the area of the web just after the splicing tape is completely avoided. In the treatment for coarsening the surface of the web, no treating solution is necessary, and therefore there is no concern in contamination of the apparatus and damaging other areas of the web. In addition, the locally too thickly coated area as in FIG. 1 can be avoided in the embodiment of FIG. 3, and any conventional drying device well suffices for the drying treatment. In fact, substantially about 1.5 times the drying ability can be attained in a conventional drying apparatus as such. In place of a coarsening with a knurling tool, when the same area is coarsened by abrasion, e.g., with sandpaper, and the web having the thus coarsened surface is coated, coating difficulty can also be avoided in the area after the splicing tape. The sandpaper used can be optionally selected. For example, when a plurality of webs of polyethylene terephthalate which are butt spliced in series with splicing tapes of a thickness of about 30 to 100 $\mu$ are coated with an X-ray photographic emulsion layer at a coating speed of about 50 to 80 m/min. and in a coating amount of about 80 to 100 cc/m$^2$, No. 400 to No. 800 sandpapers are especially preferably used. In general, No. 200 to No. 1,000 sandpapers are preferably used.

Figure 5:
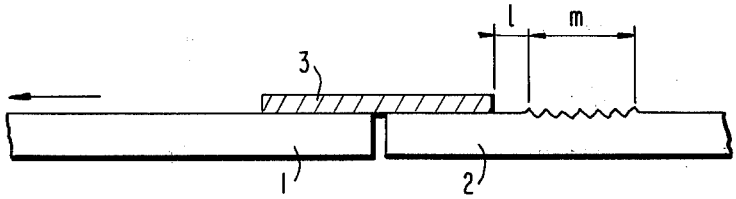

FIG. 5 shows still another embodiment of this invention, where the area of the web to be coarsened is kept apart from the trailing edge of the tape by a slight distance $l$. $m$ is a width of the coarsened area. When a plurality of webs of polyethylene terephthalate which are butt spliced in series with splicing tapes of a thickness of about 30 to 100 $\mu$ are coated with an X-ray photographic emulsion layer at a coating speed of about 50 to 80 m/min and in a coating amount of about 80 to 100 cc/m$^2$, the distance $l$ is most preferably in the range of about 0 to 5 mm. Regarding the width $m$, a fairly good result can be attained even when the width $m$ corresponds to that of one knurling roulette. However, the optimum value of each distance $l$ and width $m$ can be varied, depending upon the kind of coating solution used, the surface character of the web, the thickness of the splicing tape, the coating speed, the coating amount and other conditions, and therefore, this value is most preferably determined experimentally under actual conditions. In this respect, it is to be noted that the distance $l$ must not be so wide that it is ineffective. In general, the distance $l$ is preferably in the range of about 0 to 10 mm. Regarding the width of $m$, a fairly good result can be attained even when $m$ corresponds to the width of one knurling roulette, as described above, and even though $m$ is wider than a certain value, the effect is not lost, and therefore, it is not always necessary to define the upper limit thereof. However, it is uneconomical to extensively coarsen even an unnecessary area, and it is considered sufficient, in general, to coarsen the surface in a width of about 20 mm or so.

In addition, it is extremely effective to coarsen both the surface of the trailing edge of the splicing tape and the surface of the web immediately following the tape. However, coarsening only the surface of the trailing edge of the splicing tape is substantially ineffective. On these grounds, it is considered an indispensable element in the method of this invention to coarsen at least the surface of web immediately trailing the following edge of the splicing tape.

In coating at an extremely high coating speed, uneven coating sometimes occurs also in the discontinuous area in the leading edge of the splicing tape. In such high speed coating, therefore, it is desirable to analogously coarsen also the surface of the splicing tape immediately following the discontinuous area in the leading edge of the splicing tape.

In the above explanation the so-called "butt joint" is particularly illustrated, but the method of this invention is not limited to only this illustrated case. The present method can be applied also to other webs connected by other means such as the so-called "lap joint".

In addition, the method of this invention also is effective when applied to the coating of webs having other projections, projecting discontinuous areas or other step-like discontinuities on the surface thereof than those arising from connections with splicing tapes.

This invention will be explained in greater detail by reference to the following Example.

EXAMPLE

Webs of polyethylene terephthalate each having a width of 30 cm were butt spliced using an adhesive tape having a thickness of 50 $\mu$, and the surface of each of the thus connected webs to be coated was coarsened with a knurling roulette at a distance of 3 mm from the trailing edge of the respective splicing tape and in a width of 10 mm.

Next, the thus connected and coarsened webs were conveyed at a speed of 50m/min, whereupon an X-ray photographic emulsion having the following properties was coated on the webs in an extrusion coating method in a coating amount of 98 cc/m$^2$.

As a result, no coating specks appeared in the following area of the connected portion.

| Properties of X-ray Photographic Emulsion Used | |
|---|---|
| Gelatin Concentration | 5.0% |
| Viscosity | 30.0 cps |
| Specific Gravity | 1.09 |
| Surface Tension | 42.0 dyne/cm |

The method of this invention has various advantages, some of which are as follows:

1. In coating various kinds of coating solutions on webs having discontinuous surfaces such as areas connected with splicing tapes or the like, the occurrence of coating difficulties such as coating specks which is inevitable in conventional coating methods can be prevented and an even and good coating can be achieved.

2. In coating various kinds of coating solutions on webs having discontinuous surfaces as in (1) above, the generation of air bubbles in the area following the discontinuous area resulting from the discontinuity and adhesion of air bubbles to coating nozzles can be avoided, and therefore, a good coating can be achieved free from any defects in the coated surface due to these air bubbles such as the so-called streaks.

3. In coating various kinds of coating solutions on webs having discontinuous surface as above, uneven coating, especially an extremely too thick coating, occurring in the area following the discontinuous area due to the discontinuity can be avoided, and therefore, an unnecessary drying step or capacity which was required in conventional coating methods for drying this too thickly coated area can be omitted or the drying efficiency can be markedly improved using a conventional drying apparatus as such.

4. Since the thick coating in the area following the discontinuous area can be avoided as described in (3) above, contamination of the apparatus in the subsequent steps can thereby be avoided, resulting from the thickly coated area which remains undried, and it is unnecessary to interrupt the manufacturing procedure for cleaning the apparatus. Thus, the manufacturing efficiency can be markedly improved.

5. Coating difficulties such as coating specks can be avoided merely by coarsening the surface of the web in the area following the discontinuous area, and therefore, an even and good coating can be achieved in a simple method which does not require a complicated apparatus.

6. Coating difficulties such as coating specks occurring in the surface of the web in the area following the discontinuous area can be avoided and therefore it is possible to increase the coating speed in the method of this invention.

While the invention has been described in detail and with reference to specific embodiments thereof, it will be apparent to one skilled in the art that various changes and modifications can be made therein without departing from the spirit and scope thereof.

What is claimed is:

1. In a method for continuously coating with a coating solution a running web having projecting discontinuous areas in the surface thereof, wherein said web comprises a plurality of webs connected end to end in series with splicing tapes which produce said discontinuous areas, the improvement comprising coarsening the surface of the web to be coated at least in the area of the succeeding webs immediately following the trailing edge of each splicing tape, thereby preventing unevenness in the coating caused by said discontinuous areas.

2. The method as claimed in claim 1, wherein the surface of the webs is coarsened only in the area of the succeeding webs immediately following the trailing edge of each splicing tape.

3. The method as claimed in claim 1, including coarsening both the surface of the trailing edges of the splicing tape and the surface of the succeeding webs immediately following said trailing edges prior to coating.

4. The method as claimed in claim 1, including coarsening all of the surface of the leading edges and the trailing edges of the splicing tape and the surface of the succeeding webs immediately following said tapes prior to coating.

5. In a method for continuously coating with a coating solution a running web having projecting discontinuous areas in the surface thereof, wherein said web comprises a plurality of webs connected end to end in series with splicing tapes which produce said discontinuous areas, the improvement comprising coarsening the surface of the web to be coated in an area of the succeeding webs which is separated from the trailing edge of each splicing tape by a distance which is short enough to prevent unevenness in the coating caused by said discontinuous areas.

6. The method as claimed in claim 5, wherein the separation from the trailing edge of each tape to the surface of the webs to be coarsened is 0 to 10 mm.

7. The method as claimed in claim 6, wherein said separation is 0 to 5 mm.

* * * * *